US005303786A

United States Patent [19]

Prestridge et al.

[11] Patent Number: 5,303,786

[45] Date of Patent: Apr. 19, 1994

[54] EARTH DRILLING CUTTINGS PROCESSING SYSTEM

[75] Inventors: Mark L. Prestridge, Anchorage; Theron W. Anderson; Mark W. Chadwell, both of Wasilla; Larry E. Ross, Anchorage; Gary A. Smith, Wasilla, all of Ak.

[73] Assignee: Atlantic Richfield Company, Los Angeles, Calif.

[21] Appl. No.: 946,268

[22] Filed: Sep. 16, 1992

[51] Int. Cl.[5] ..... E21B 21/06

[52] U.S. Cl. ..... 175/66; 175/206; 175/207

[58] Field of Search ..... 175/66, 88, 206, 207

[56] References Cited

U.S. PATENT DOCUMENTS

| | | | |
|---|---|---|---|
| 2,886,287 | 5/1959 | Croley | 175/206 |
| 3,777,405 | 12/1973 | Crawford | 175/66 X |
| 4,222,988 | 9/1980 | Barthel | 175/66 X |
| 4,295,534 | 10/1981 | Zachmeier | 175/66 X |
| 4,474,254 | 10/1984 | Etter et al. | 175/206 |
| 4,480,702 | 11/1984 | Kelly | 175/66 |
| 4,878,576 | 11/1989 | Dietzen | 175/66 X |
| 4,942,929 | 7/1990 | Malachosky et al. | 175/66 |
| 5,109,933 | 5/1992 | Jackson | 175/66 |
| 5,129,469 | 7/1992 | Jackson | 175/66 |

OTHER PUBLICATIONS

SPE Paper No. 22092 "The Cuttings Grinder" by R. I. Smith, Society of Petroleum Engineers, Inc., 1991.

*Primary Examiner*—Ramon S. Britts
*Assistant Examiner*—Roger J. Schoeppel
*Attorney, Agent, or Firm*—Michael E. Martin

[57] ABSTRACT

Drill cuttings and similar earth materials are reduced in particle size, slurried and disposed of from a system which includes a ball mill, a reduced particle receiving tank, a grinder pump in communication with the receiving tank and separator screens for receiving a slurry of particles which have been reduced in size through the ball mill and the grinder pump. The underflow of the separator is suitable for discharge for final disposal, oversized particles are returned to the ball mill and the underflow discharged from the separator is controlled to maintain a certain level in the primary receiving tank. A secondary tank may receive a portion of the underflow to be mixed with viscosifiers and dispersants to maintain a suitable slurry composition for discharge. The system may be mounted on a semi-trailer and in weather-proof enclosures with the ball mill, receiving tanks and grinder pump on a first level and the separators on a second level. Receiving hoppers for wet drill cuttings as well as frozen or dried cuttings are provided and water or steam may be mixed with the cuttings and conveyed by a bucket elevator from the first level to the second level of the enclosures.

24 Claims, 2 Drawing Sheets

EARTH DRILLING CUTTINGS PROCESSING SYSTEM

BACKGROUND OF THE INVENTION

1. Field of the Invention

The present invention pertains to a processing system including screening and grinding devices for processing earth drilling cuttings and the like to form a slurry of fine particles and liquid which may be injected through wells into the earth as a way of disposal.

2. Background

The generation of wetted earth particles during drilling of oil and gas wells and the like, as well as the generation of certain types of grindable materials which may be disposed of through deep injection wells has resulted in the development of certain processes and systems for preparing slurries of finely ground particles which are suitable for deep well injection. U.S. Pat. No. 4,942,929, issued Jul. 24, 1990 to Malachosky et al, and U.S. Pat. Nos. 5,109,933 and 5,129,469, issued May 5, 1992 and Jul. 14, 1992, respectively, to J. E. Jackson, all assigned to the assignee of the present invention, describe disposal systems for earth drilling wastes and the like. In particular, the system described in the Jackson patent includes a modified centrifugal pump which is operable to reduce the particle size of certain types of earth material generated during the drilling of wells primarily by a shearing action. However, the drill cuttings disposal system described in the Jackson patent is not well suited to processing cuttings of relatively hard earth materials. In this regard, it has been determined that a device for reducing drill cuttings particle size, such as a ball mill or the like, is better adapted to handle certain sands, gravels and other earth materials that cannot be adequately ground by a shearing type action. A treatise entitled: "The Cuttings Grinder" by R. I. Smith, Society of Petroleum Engineers, Inc. (SPE 22092), 1991 , describes one system using a ball mill for grinding drill cuttings.

Still further, however, there has developed a need for a portable earth drilling cuttings processing system which is not only adapted to receive wet cuttings from drilling operations but also to receive and process cuttings which have been previously disposed of in so-called reserve pits associated with drilling operations. It is also desirable that a drilling cuttings processing system be provided which is adapted for operation in harsh environments and which may be easily moved from one site to another where drilling wastes are being generated or have previously been generated and disposed of on the earth's surface. Still further, there has been recognition of a need for a processing system that may be used to process materials similar to drill cuttings but which have been generated from other sources. It is to this end that the present invention has been developed.

SUMMARY OF THE INVENTION

The present invention provides an improved processing system for reducing the particle size of earth drilling cuttings and similar materials so that these cuttings may be transported in a slurry for injection into the earth through disposal wells, for example.

In particular, it is an object of the present invention to provide a system for disposing of earth drilling cuttings generated during the drilling of oil and gas wells and the like whereby a pumpable slurry of fine particles and a carrier liquid may then be injected into the earth and disposed of in suitable subterranean earth formations such as by fracturing the formation under high injection pressures. Accordingly, the solid particles must be reduced to sizes which are easily held in suspension in a slurry and pumped for injection under high pressure into the earth.

In accordance with another aspect of the present invention, there is provided an improved drilling cuttings processing system which utilizes one or more screening devices, a particle size reduction device, such as a ball mill, and a recirculating circuit to maximize the chance of reducing all of the drilling cuttings, or other solids particles, to a particle size which may be easily pumped under relatively high pressures by a positive displacement injection pump through well tubulars into a subterranean formation.

Still further, the present invention provides a unique drilling cuttings processing system which is adapted to handle wet cuttings directly from a drilling operation or cuttings which have been previously generated and disposed of on the earth's surface, whether in a frozen or unfrozen condition.

In accordance with yet a further aspect of the present invention, a drilling cuttings processing system is provided which is arranged in a unique manner for portability and for ease of receiving and processing the drilling cuttings or feed material to the system.

Those skilled in the art will recognize the abovementioned aspects of the present invention, together with other superior features, upon reading the detailed description which follows in conjunction with the drawing.

DESCRIPTION OF PREFERRED EMBODIMENTS

Figure 1:
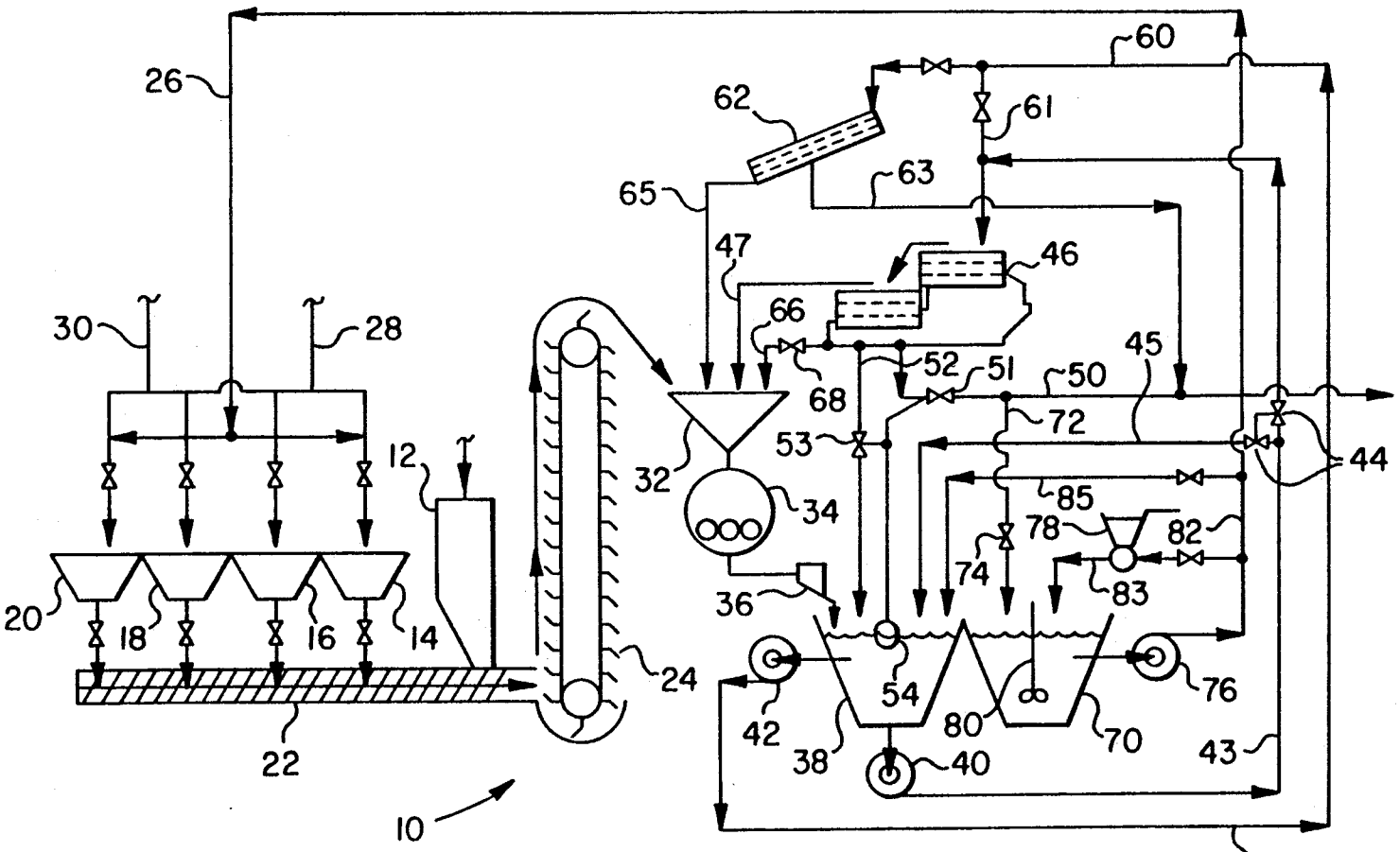
FIG. 1 is a schematic diagram of the drilling cuttings processing system of the present invention.

In the description which follows, like parts are marked throughout the specification and drawings with the same reference numerals, respectively. The drawing figures are not necessarily to scale and certain elements are shown in schematic or outline form in the interest of clarity and conciseness.

Referring to FIG. 1, there is shown a schematic diagram of the major components of the system of the present invention as well as the flow paths of the materials which are treated and processed. The system of the present invention, as shown in FIG. 1, is generally designated by the numeral 10. The system 10 includes plural material receiving hoppers 12, 14, 16, 18 and 20. Each of these hoppers is provided with an outlet path to an auger type conveyor 22 which is in material flow communication with a bucket elevator 24. The hopper 12 is adapted to receive a slurry of drill cuttings from a conventional drilling mud circulation system of a drilling rig, both not shown in FIG. 1. Accordingly, the hopper 12 receives a slurry of material which comprises earth drill cuttings, water and some of the additives which are used to make up drilling fluid or "mud".

The system 10 is also adapted to receive cuttings which have dried or which have become a frozen mass and which may be deposited by suitable material handling equipment into one or more of the hoppers 14, 16, 18 and 20. In order for the material deposited in the hoppers 14, 16, 18 and 20 to become a flowable mixture, fluid from the system 10 may be required and either recirculated by way of a conduit 26, or fluid in the form of water or steam may be discharged into the respective hoppers from sources not shown in FIG. 1 in communication with conduits 28 and 30, respectively. In this way, material in the hoppers 14, 16, 18 and 20 may be suitably wetted and made more "fluid" for conveyance through the system 10.

Conveyor means comprising the bucket elevator 24 is adapted to discharge material into a receiving hopper 32 for a particle size reduction device comprising a vibrating ball mill 34. The ball mill 34 is adapted to reduce the particle size of the solids material injected into the mill to not exceed about 200 microns maximum particle size and preferably on the order of 80 microns or less. The material discharged from the ball mill 34 passes through a coarse screen 36 which includes suitable magnets associated therewith for collecting magnetic materials.

The slurried cuttings processed by the ball mill 34 are discharged to a holding tank 38 which is in communication with a pump 40 adapted to further reduce the particle size of the cuttings and a second pump 42 which is in communication with the tank 38 at a level above the pump 40. The pump 42 is operable to pump fluid out of tank 38 to control the fluid level therein. Moreover, the pump 42 is also operable for skimming solids material that may have a tendency to float in the viscous liquid held in the tank 38 and also provide a second outlet from the tank 38 to serve as a source of fluid for conduit 26 and other parts of the system 10. The pump 40 may include features similar to the pump described in U.S. Pat. Nos. 5,109,933 and 5,129,469. The slurry discharged from the pump 40 is conducted by way of a conduit 43 to separator means comprising a set of cascading screens 46 whereby separation of solids of a predetermined minimum size from the slurry may be carried out and the solids so separated discharged by way of path 47 back into the ball mill receiving hopper 32. The slurry which passes through the cascading screens 46, also known as the underflow, may be conducted by way of a conduit 50 to a suitable injection pump, not shown, for injection of the slurry into a well or other process.

Alternatively, some of the underflow slurry which is suitable for discharge from the system 10 may also be recirculated back to the tank 38 by way of a conduit 52. Suitable control valves 51 and 53 are interposed in the conduits 50 and 52, respectively, and are associated with a liquid level control device 54 for maintaining a predetermined level of slurry in the tank 38. Accordingly, the valves 51 and 53 may be controlled in concert to maintain a level of slurry in the tank 38 and discharge the remainder of slurry suitable for conveyance to the aforementioned injection pump by way of the conduit 50. Still further, the discharge flow from pump 42 may be returned, all or partially, directly back to the tank 38 through a conduit 45. Suitable control valves 44 are interposed in each of the conduits 43 and 45 and may be operably interconnected to control the slurry flow to the separator screens 46 and the tank 38, respectively.

Material "skimmed" from the tank 38 by the pump 42 is conducted by way of a conduit 60 to one of a separator screen 62 or back to the cascading screens 46 by way of a branch conduit 61. Suitable valves are interposed in the conduits 60 and 61 for controlling the flow of the slurry from the pump 42. Material which does not pass through the screen 62 is returned to the hopper 32, as indicated, by way of path 65, and slurry which passes through the screen 62 may be conducted by way of a conduit 63 to conduit 50 for discharge from the system 10. If the material being discharged into the hopper 32 for processing by the ball mill 34 requires further "fluidizing", some of the slurry ready for discharge from the system 10 and comprising the underflow of the screens 46 may be conducted to the hopper 32 by way of a conduit 66 having a suitable control valve 68 interposed therein.

The system 10 includes a second tank 70 for containing a quantity of slurry which is ready for injection by way of the conduit 50. The tank 70 is adapted to receive such material from a conduit 72 having a suitable shut-off valve 74 interposed therein. The tank 70 is also in communication with a so-called skimming pump 76 for circulating fluid from the tank 70 to a conventional mixing hopper 78 whereby the slurry in the tank 70 may be mixed with suitable solids materials such as dispersants, weighting agents and viscosifiers to modify the viscosity of the slurry and otherwise treat the slurry to prevent settling of the ground solids which are ready for discharge from the system by way of the conduit 50. In this regard, a suitable mechanical agitator 80 is disposed in the tank 70 for thoroughly mixing the contents of the tank including the additives which are added to the fluid in the tank by way of the mixing hopper 78. The pump 76 conducts fluid from the tank 70 by way of a conduit 82, selectively, to the mixing hopper 78 by way of a conduit 83 having a suitable control valve therein, and/or to the tank 38 by way of a valve controlled conduit 85 and/or to the hoppers 14, 16, 18 and 20 by way of conduit 26 for mixing with the incoming dried or frozen cuttings which are normally added to the system 10 through these hoppers.

The system 10 holds several advantages for processing earth drilling cuttings and similar solids materials for preparation of a slurry which may be injected into a subterranean formation in accordance with the teaching of U.S. Pat. No. 5,109,933 and also to enjoy the benefits of the invention described in U.S. patent application Ser. No. 07/910,381, filed Jul. 8, 1992 by Thomas K. Perkins, and assigned to the assignee of the present invention. In particular, all of the material which is to be treated by the system is subjected to crushing and grinding by the ball mill 34 to reduce or eliminate the chance of oversized material passing through the system without crushing treatment. Substantially all of the solids material which is more dense than the slurry in the tank 38 is also subjected to a further particle size reduction step by being pumped through the pump 40. All of the material which passes through the ball mill 34 and the pump 40 is then subjected to a two-stage screening process to substantially assure that only material which has had its particle size reduced to that acceptable for injection or further treatment is ready for discharge from the system 10. The system advantageously utilizes at least a portion of the slurry, which has had its solids particle size already reduced and is ready for discharge from the system, for mixing certain additives such as dispersants or viscosifiers to the slurry.

The system 10 is also adapted to receive solids which are already entrained in a fluid as well as solids which have been frozen or are dried and which may be refluidized before being conducted to the primary particle size reduction means comprising the ball mill 34 and the secondary means comprising the pump 40.

Still further, the system 10 includes an advantageous arrangement of control over the fluid or slurry being discharged from the system as compared with the amount of fluid held in the primary holding tank which is interposed between the primary particle size reducer or ball mill and the secondary particle size reducer or pump 40. The system 10 also advantageously provides control over the amount of fluid discharged from the primary holding tank and recirculated back to the primary holding tank after passing through the secondary particle size reducer comprising the pump 40.

Figure 2:
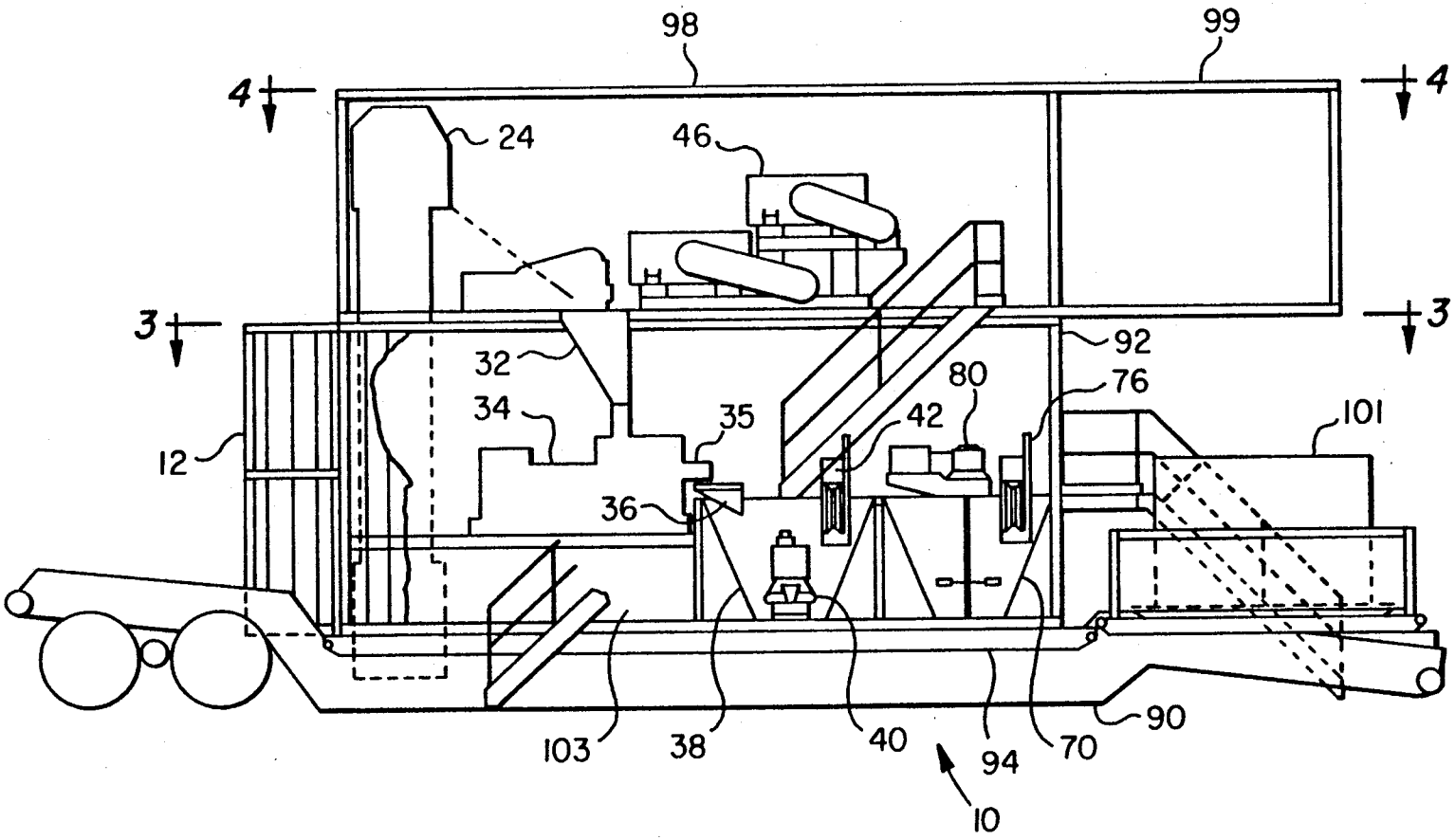
FIG. 2 is a side elevation of a trailer mounted embodiment of the system of the present invention showing the general location of major components.
Figure 3:
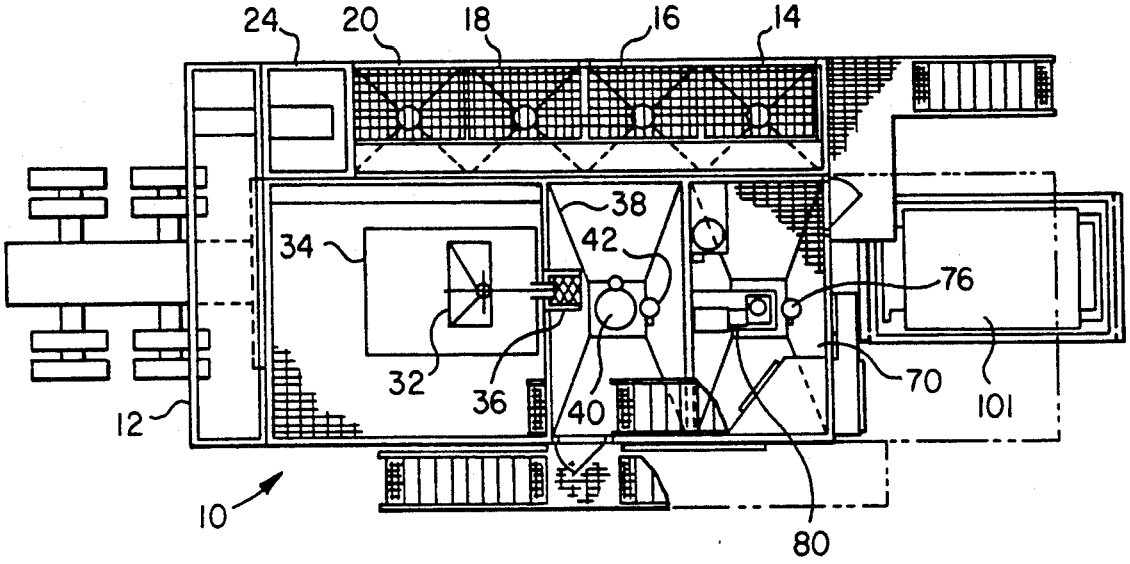
FIG. 3 is a plan view of the first level of the trailer mounted system of FIG. 2 and is taken generally along the line 3—3 of FIG. 2.
Figure 4:
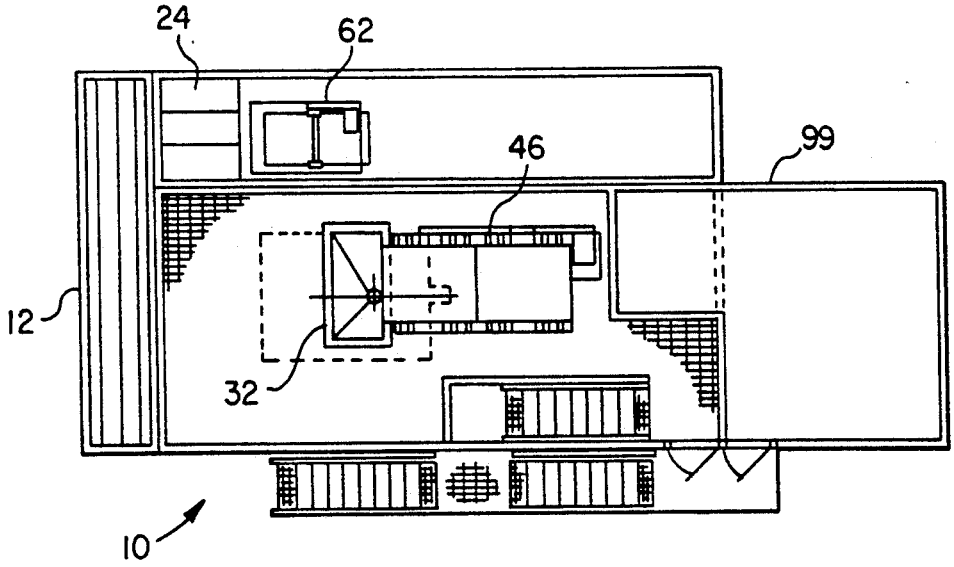
FIG. 4 is a plan view of the upper or second level of the trailer mounted system and taken generally along the line 4—4 of FIG. 2.

Referring now to FIGS. 2 through 4, the system 10 is illustrated in a preferred arrangement which is desirable for transport of the system from one work site to another. As previously mentioned, the system 10 is advantageous in that it may be easily moved to a site where a large quantity of material to be treated is available, such as existing or abandoned reserve pits which hold large quantities of earth drilling cuttings, or the like. FIG. 2, in particular, shows the system 10 mounted on a rock-over type semi-trailer 90 for being towed by suitable tractor means, not shown, between work sites. The system 10 is essentially arranged on two levels on the trailer 90 and includes a first enclosure 92 comprising a generally rectangular housing which is constructed of suitable weather-proof material and mounted on a conventional oil field type skid 94. The enclosure 92 houses the tank 70, the tank 38, the ball mill 34, the grinder or particle size reduction pump 40, the agitator 80 and the skimming pumps 42 and 76. The enclosure 92 also includes the material receiving hopper 32 mounted above the ball mill 34 and the magnet screen 36 interposed between the ball mill discharge port 35 and the tank 38. The material receiving hopper 12 is mounted aft of the enclosure 92 on the trailer 90 and above the conveyor 22 which is not shown in FIG. 2.

The system 10 includes a second generally rectangular enclosure 98 mounted on and above the enclosure 92 and of similar construction. As shown in FIGS. 3 and 4 the bucket elevator 24 extends alongside the enclosures 92 and 98 and includes a suitable discharge chute, not shown, which is in communication with the inlet hopper 32 for the ball mill 34. Also, the receiving hoppers 14, 16, 18 and 20 are disposed alongside the enclosure 92 as shown in FIG. 3 and, of course, are adapted to discharge their contents into the conveyor 22 which runs beneath these hoppers but is not illustrated in FIGS. 2, 3 or 4. At least a portion of the conveyor 22 is in communication with the hopper 12 for feeding material to the bucket elevator 24 also. The conveyor 22 may, in fact, be two separately driven augers in communication with the elevator 24 and having flights which are of opposite hand or which are rotated in opposite directions, if of the same hand. FIG. 3 also illustrates the arrangement of the tanks 38 and 70, the pumps 40, 42 and 76 and the motor driven agitator 80 for the tank 70.

FIG. 4 shows the general arrangement of the cascading screens 46 in the enclosure 98, as does FIG. 2, and FIG. 4 also shows the location of the secondary screen 62. The enclosure 98 includes a forward extension 99 which may be adapted to house a suitable engine-driven generator set, not shown, as well as a boiler, also not shown, for generating steam to be used in fluidizing frozen cuttings deposited in the hoppers 14, 16, 18 or 20. A suitable skidmounted diesel fuel tank 101 is disposed on the trailer 90 forward of the enclosure 92 as shown in FIGS. 2 and 3. The enclosures 92, 98 and 99 may be suitably insulated against cold weather climates and are advantageously arranged relative to each other to house the components of the system 10. The hoppers 14, 16, 18 and 20 may be enclosed by suitable overhead roll-type access doors, not shown. Suitable access stairways to the operating components are also illustrated in FIGS. 2, 3 and 4. Additional components such as a water supply tank 103 are housed in the enclosure 92. Heating and ventilation equipment for the enclosures 92, 98 and 99 are not shown and are not considered to be part of the present invention.

The ball mill 34 may be of a conventional type such as a so-called tumbler type crusher with replaceable shot. The pump 40 and the pumps 42 and 76 may all be of a submersible electric motor driven type so that they may be disposed in the respective tanks 38 and 70. The dual screens 46 may be, by way of example only, a standard oil field type shale shaker such as a model manufactured by Brandt Solids Control Division of TRW, Houston, Tex. as their model "Tandem II". The mud agitator 80 may also be of a type manufactured by Brandt Solids Control Division. The components described above, including suitable controls and utility equipment, may all be of a type commonly used in process equipment and oil field process equipment, in particular. The unique process method and overall system described above as well as the compact and portable arrangement provides a drill cuttings and similar earth materials processing system which is believed to be unique and patentably distinct from that which is known in the art.

The operation of the system 10 is believed to be readily understandable from the foregoing description. However, briefly, cuttings conveyed to the bucket elevator 34 from any of the receiving hoppers are conveyed directly to the inlet hopper 32 for the ball mill 34. Cuttings ground to no more than 200 microns maximum size are discharged from the ball mill 34 and passed through the screen 36 having the suitable previously mentioned magnets disposed therein for extracting magnetic materials before the ground cuttings are discharged into the tank 38. The pumps 40 and 42 may be operated as needed to circulate the cuttings slurry discharged from the tank 38 to the separation means comprising the cascading screens 46. Thanks to the series arrangement of the ball mill 34 and the pump 40 the "cuttings" or solids particles may be reduced to particle sizes less than 200 microns. Underflow from the screens 46 may, of course, be controlled to flow directly to the system discharge conduit 50, and/or to the tank 38 and/or to the inlet hopper 32 if additional slurry is required to change the composition of the slurry in the tank 38 and/or mix with the incoming cuttings being charged to the ball mill 34, respectively. The valves 51 and 53 are adjusted to maintain a set point of liquid level in the tank 38.

If it is indicated that the solids particles in the fluid stream being discharged through the conduit 50 will not be adequately maintained in suspension, the viscosity of the slurry being discharged may be adjusted by recirculating a quantity of such fluid by way of the conduit 72 as controlled by the valve 74 into the tank 70 to be mixed with a suitable viscosifier and/or dispersant. The slurry composition in tank 70 is then recirculated by way of the pump 76 to either the tank 38 or used to fluidize the cuttings in the hoppers 14, 16, 18 and 20.

Although preferred embodiments of a system and method have been described above, those skilled in the art will recognize that various substitutions and modifications may be made to the invention without departing from the scope and spirit of the appended claims.

What is claimed is:

1. A system for reducing the particle size of drill cuttings and similar earth materials for inclusion in a disposal slurry, said system comprising:

hopper means for receiving said drill cuttings;

conveyor means for conveying said drill cuttings from said hopper means to a particle size reduction apparatus;

particle size reduction apparatus for reducing the particle size of said drill cuttings to about 200 microns or less;

first separator means for separating oversize particles from said slurry;

a first tank for receiving reduced particles of said drill cuttings;

first pump means for conveying said slurry to said first separator means;

means for returning said oversized particles to said particle size reduction apparatus;

first conduit means for conducting a slurry of reduced particles from said first separator means away from said system for disposal; and second conduit means for conducting at least a portion of said slurry of reduced particles from said first separator means to said first tank.

2. The system set forth in claim 1 wherein:

said means for receiving said cuttings comprises plural hopper means and said system icnldues means for conducting fluid to said plural hopper means for mixing with said drill cuttings to form a slurry of said drill cuttings for conduction to said particle size reduction apparatus.

3. The system set forth in claim 1 wherein:

said first pump means is connected to said first tank and is operable to further reduce the particle size of said drill cuttings.

4. The system set forth in claim 1 including:

second pump means for conducting a portion of the contents of said first tank to at least one of said first separator means and a second separator means.

5. The system set forth in claim 4 including:

a third conduit means for conveying particles separated by said second separator means to said particle size reduction apparatus.

6. The system set forth in claim 1 including:

a second tank for receiving at least a part of said slurry of reduced particles from said first separator means;

means for introducing materials into said slurry of reduced particles in said second tank to modify at least one of the viscosity and the particle settling rate of said slurry of reduced particles; and second pump means in communication with said second tank for circulating the contents of said second tank to at least one of said first tank and said second tank, respectively.

7. The system set forth in claim 6 including:

means associated with said second tank for mixing the contents of said second tank to maintain particles of said drill cuttings in suspension in said slurry.

8. The system set forth in claim 7 including:

conduit means for conducting at least a portion of said slurry from one of said tanks to means for receiving said drill cuttings for mixing with said drill cuttings prior to conveying said drill cuttings to said particle size reduction apparatus.

9. The system set forth in claim 1 including:

control means for controlling the flow of said slurry from said first means to said first tank and through said conduit means for conducting slurry from said system, respectively.

10. The system set forth in claim 1 including:

means for selectively controlling the flow of said slurry from said first tank by way of said first pump means to said first tank and to said first separator means, respectively.

11. The system set forth in claim 1 wherein:

said particle size reduction apparatus is a ball mill.

12. A system for reducing the particle size of earth materials such as drill cuttings and the like for inclusion in a disposal slurry, said system comprising:

a particle size reduction apparatus for reducing the particle size of said earth materials to about 200 microns or less;

a first receiving tank for receiving a slurry of reduced particles and liquid from said apparatus;

first pump means in communication with said first receiving tank for pumping said slurry to separator screen means;

separator screen means for screening oversize particles from said slurry and for discharging said slurry from said system for disposal;

means for recirculating said oversize particles to said particle size reduction apparatus; and means for conducting fluid to said first receiving tank to modify the composition of said slurry being pumped to said separator screen means.

13. The system set forth in claim 12 including:

second pump means interposed between said first receiving tank and said separator screen means for pumping said slurry to said separator screen means and for further reducing the particle size of said earth material.

14. The system set forth in claim 12 including:

means for returning a portion of said slurry suitable for discharge from said separator screen means to said first receiving tank.

15. The system set forth in claim 14 including:

a second receiving tank, conduit means for conducting a portion of said slurry discharged from said separator screen means to said second receiving tank and means for circulating slurry from said second receiving tank to at least one of said first receiving tank and to means for receiving said earth materials prior to introduction of said earth materials to said particle size reduction apparatus.

16. A portable system for reducing the particle size of drill cuttings from at least one of a drilling operation, a reserve pit and the like and for forming a slurry of said drill cuttings for subsequent disposal, said system comprising:

a vehicle for conveying said system overland;

a first enclosure mounted on said vehicle and containing a particle size reducing apparatus, a receiving tank for receiving the discharge of said particle size reducing apparatus and pump means for conveying a slurry from said receiving tank to separator means for said system;

a second enclosure mounted above said first enclosure and including separator means for receiving a slurry of said particles and for separating oversized particles from said slurry, conduit means connected to said separator means for discharging said slurry from said system, said separator means being in communication with a receiving hopper for said particle size reducing apparatus extending between said enclosures; and conveyor means extending between said enclosures for conveying said drill cuttings to said receiving hopper for said particle size reducing apparatus.

17. The system set forth in claim 16 including:

hopper means for receiving drill cuttings, said hopper means being mounted adjacent one of said enclosures and being in communication with said conveyor means.

18. A method for reducing the particle size of particulate solids such as earth drill cuttings and for generating a slurry of reduced size particles in suspension for conduction to a disposal site, said method comprising the steps of:

providing a system including a first particle size reduction apparatus, separator means for separating oversize particles from a slurry of particles in a carrier fluid and a first receiving tank for receiving a slurry of reduced size particles which have been reduced in size by said first apparatus;

adding a carrier fluid to said solids;

conveying said solids and carrier fluid to said first apparatus;

reducing the particle size of said solids and discharging said solids and said carrier fluid as a slurry to said first tank;

conveying said slurry from said first tank to said separator means and returning oversize particles of said solids from said separator means to said first apparatus;

conveying at least a portion of said slurry from said separator means away from said system for disposal; and conveying a further portion of said slurry from said separator means to said first tank.

19. The method set forth in claim 18 including the step of:

providing pump means for further reducing the particle size of said solids and passing said slurry from said first tank means through said pump means before conveying said slurry to said separator means.

20. The method set forth in claim 19 including the step of:

recirculating a portion of said slurry from said pump means to said first tank.

21. A method for reducing the particle size of particulate solids such as earth drill cuttings and for generating a slurry of reduced size particles in suspension for conduction to a disposal site, said method comprising the steps of:

providing a system including a first particle size reduction apparatus, separator means for separating oversize particles from a slurry of particles in a carrier fluid and first and second receiving tanks for receiving a slurry of reduced size particles which have been reduced in size by said first apparatus;

adding a carrier fluid to said solids;

conveying said solids and carrier fluid to said first apparatus;

reducing the particle size of said solids and discharging said solids and said carrier fluid as a slurry to said first tank;

conveying said slurry from said first tank to said separator means and returning oversize particles of said solids from said separator means to said first apparatus;

conveying at least a portion of said slurry from said separator means away from said system for disposal;

conveying a portion of said slurry from said separator means to said second tank; and mixing said slurry in said second tank with means for modifying the composition of said slurry.

22. The method set forth in claim 21 including the step of:

recirculating a portion of the slurry in said second tank to said first tank to modify the composition of said slurry in said first tank.

23. The method set forth in claim 21 including the step of:

conveying a portion of the slurry in said second tank to a receiving hopper for said solids to fluidize said solids prior to introduction of said solids to said particle size reduction apparatus.

24. A system for reducing the particle size of drill cuttings and similar earth materials for inclusion in a disposal slurry, said system comprising:

separator means for separating oversized particles from a slurry of particles of said drill cuttings;

means for conducting a slurry of particles of said drill cuttings and a carrier liquid to said separator means;

a receiving tank for receiving slurry directly from said separator means which has passed through said separator means and which includes particles of a reduced size and separated from said oversized particles in said slurry;

a particle size reduction apparatus in communication with said separator means for receiving said oversized particles separated from said slurry passing through said separator means and for discharging reduced size particles to said receiving tank; and pump means for pumping a slurry of reduced size particles which have passed through said particle size reduction apparatus to said separator means.

* * * * *